United States Patent [19]

Berner

[11] 4,159,568

[45] Jul. 3, 1979

[54] CAPSULE BOX

[75] Inventor: Howard E. Berner, Summit, N.J.

[73] Assignee: Pharmacaps, Inc., Elizabeth, N.J.

[21] Appl. No.: 879,858

[22] Filed: Feb. 22, 1978

[51] Int. Cl.[2] ..... B25F 3/00

[52] U.S. Cl. ..... 30/124; 83/648; 206/528; 131/250; 225/103

[58] Field of Search ..... 206/528, 530; 131/250; 225/103, 43; 83/588, 648; 30/124, 2

[56] References Cited

U.S. PATENT DOCUMENTS

| | | | |
|---|---|---|---|
| 322,105 | 7/1885 | Istel | 131/250 |
| 1,826,809 | 10/1931 | Metz | 206/530 |
| 2,655,259 | 10/1953 | Davoren | 225/103 |
| 2,655,767 | 10/1953 | Wenner | 225/103 |
| 3,512,666 | 5/1970 | Swartz | 30/2 |
| 3,910,144 | 10/1975 | Hess | 83/588 |

FOREIGN PATENT DOCUMENTS

| | | | |
|---|---|---|---|
| 1362603 | 4/1964 | France | 206/485 |

*Primary Examiner*—William T. Dixson, Jr.
*Attorney, Agent, or Firm*—Kenyon & Kenyon

[57] ABSTRACT

A container for capsules and the like having a cutter associated with the container for cutting the capsules is disclosed. Hinged upper and lower portions of the container have cutting members secured thereto. Closure of the container portions effects cutting of a capsule inserted between the cutting members. In the preferred embodiments, the cutting members comprise a trough-shaped notch in the front wall of one of the container portions and a blade secured to the front wall of the other of the container portions, the blade and notch being superposed. An internal compartment is provided to receive a cut portion of a capsule.

11 Claims, 10 Drawing Figures

CAPSULE BOX

BACKGROUND OF THE INVENTION

1. Field of the Invention

The present invention relates to containers for holding capsules and the like and more particularly to a container having a cutter for cutting the capsules.

2. Description of the Prior Art

It is quite often necessary to cut pharmaceutical capsules and the like either to extract the substance contained in the capsule or to reduce the size of the dosage. Capsules as used herein are intended to include small containers and vials for pharmaceuticals, and pills and similar dosage forms. Heretofore, a knife, scissors or other instrument was required to cut the capsule. Such cutting instruments, however, are not usually carried and cutting a capsule while away from one's home or place of business presented an inconvenience. Moreover, even when one was in his home or place of business, it was inconvenient to cut the capsule since one still had to obtain a cutting instrument which was not usually stored with the capsules.

In accordance with the invention disclosed herein, capsules are stored and/or carried in a container in which the capsules may easily and conveniently be cut without the need for cutting instruments separate from the container.

SUMMARY OF THE INVENTION

It is an object of the present invention to provide a container for capsules and the like in which the capsules may be easily and conveniently cut by the container.

It is also an object of the present invention to provide a container for capsules and the like having cutting means associated therewith.

It is still another object of the present invention to provide a container for capsules and the like in which a portion of a capsule cut by the container is received within the container by means within the container.

These and other objects are achieved by providing cutting means associated with the container for cutting the capsules and means in the container for receiving a cut portion of the capsule. The cutting means include means for engaging the capsule during cutting.

In accordance with the invention, a container is provided having hinged upper and lower container portions and cutting means secured to the container portions which are operative to cut a capsule inserted therebetween upon closure of the container. The cutting means comprise a cutting member secured to each of the container portions. Further in accordance with the invention, an internal compartment, from which the remainder of the interior of the container is separated, is provided to receive a cut portion of a capsule.

In the preferred embodiments, the cutting members comprise a trough-shaped notch in a wall of one of the container portions and a blade secured to the opposed wall of the other container portion, the blade and notch being superposed and cooperating to form a shear. The blade in the respective container portion includes a projecting V-shaped blade portion.

Further in accordance with the preferred embodiments, the internal compartment comprises compartment portions formed by walls projecting from the top end and bottom end of the container top and bottom, the compartment portions being adjacent the cutting members with a front wall of a respective container portion being a wall of a respective compartment portion.

In the preferred embodiments, each container portion is a unitary piece of molded plastic which includes the cutting means, internal compartment portions, hinges and locking means.

These and other aspects of the invention will be more apparent from the following description of the preferred embodiment thereof when considered with the accompanying drawings and appended claims.

BRIEF DESCRIPTION OF THE DRAWINGS

The present invention is illustrated by way of example and not limitation in the figures of the accompanying drawings in which like references indicate similar parts and in which.

DESCRIPTION OF THE PREFERRED EMBODIMENTS

Figure 1:
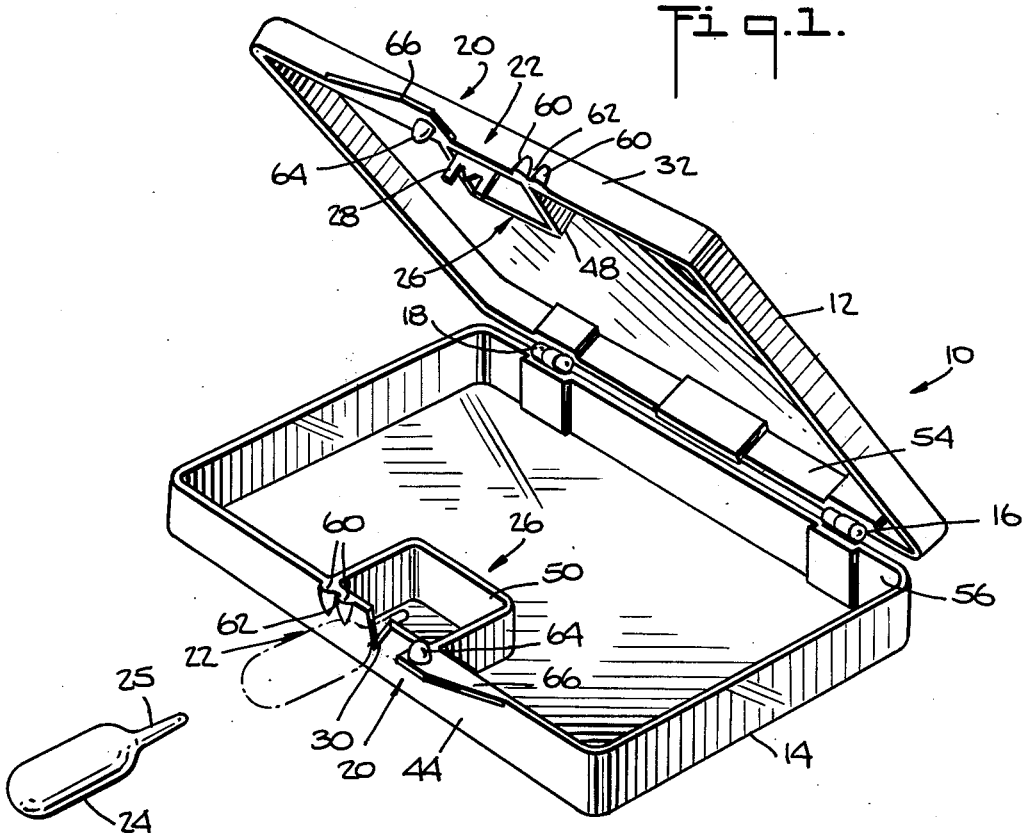
FIG. 1 is a front perspective view of the capsule box according to the invention with the box being partially opened.

Referring now more particularly to the drawings, the capsule box 10 includes a top 12 and a bottom 14 which are hinged together by hinges 16 and 18. The top and bottom each are a unitary piece molded from plastic material and are defined by four side walls extending from a top end and bottom end, respectively. Snap latches 20 are provided to lock the box closed. The box is provided with a cutter referenced generally by 22 which is used to cut a gelatin capsule 24 having a tip 25. The capsule tip is inserted between the top and bottom of the box and closure of the box cuts the capsule. An internal compartment 26 is provided for receiving the cut tip 25 of the capsule.

Figure 3:
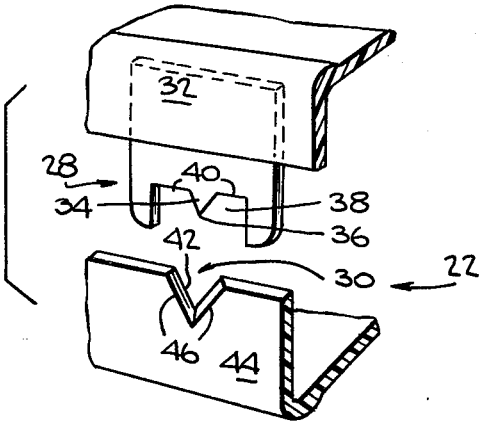
FIG. 3 is an enlarged front view of a portion of the box of FIG. 1 depicting the cutter according to the invention.
Figure 4:
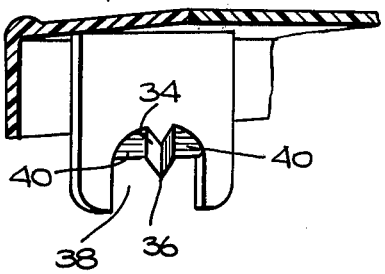
FIG. 4 is an enlarged rear view of the upper blade of the cutter.

The cutter 22 includes an upper blade 28 in the top of the box and a lower blade 30 in the bottom of the box. The upper blade 28 is centrally disposed along the inside of the front wall 32 of the top of the box, extending downwardly beyond the edge of the wall. Upper blade 28 (FIGS. 3 and 4) includes a projecting V-shaped blade portion 34 terminating in an apex 36 centrally located in cut-out 38 and blade edges 40 adjacent blade portion 34. The projecting blade portion 34 and the edges 40 are tapered (FIG. 4) on the surface of blade 28 facing the inside of the box so that edges 40 and blade portion 34 form cutting edges, the side of blade 28 facing the outside of the box being planar surfaced (FIG. 3).

The lower blade 30 comprises a V-shaped notch 42 centrally located in the front wall 44 of the bottom of the box. The notch 42 is disposed below blade portion 34. The edges 46 of the notch are tapered on the surface of wall 44 facing the outside of the box so that they also form cutting edges. The inside of wall 44 is planar surfaced. The edges of notch 42 and upper blade 28 are oppositely tapered forming a shear and cooperating to cut the tip of a capsule inserted therebetween upon closing of the top and bottom of the box. The tip 25 of the capsule is inserted into the V-shaped notch as shown in phantom in FIG. 1 and the box is closed. The tip becomes engaged in the notch under the action of the apex of the projecting blade portion 34 which first pierces the capsule tip. Engaging the capsule facilitates cutting of elastic gelatin capsules and improves the cutting action of the blades. The tip is then severed under the continuing action of blade portion 34 and edges 40 of the upper blade and edges 46 of the notch.

The severed capsule tip 25 falls into the internal compartment 26 formed by an upper compartment half 48 and a lower compartment half 50 (FIG. 1). The upper and lower compartment halves are formed by walls extending into the interior of the box from the top and bottom ends, respectively, the front wall 32 forming one wall of the upper compartment half and the front wall 44 forming one wall of the lower compartment half. The compartment halves are superposed upon closing of the box to form the closed compartment 26. Thus, a severed tip received in the compartment is retained therein and isolated from the capsules remaining in the box.

Figure 5:
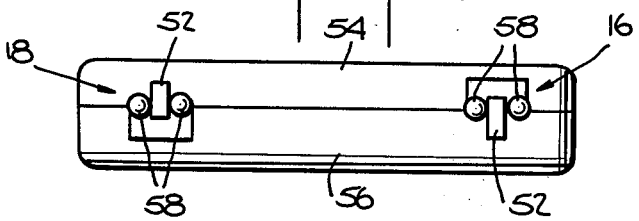
FIG. 5 is a rear view of the closed box of FIG. 2.

Each hinge 16,18 (FIG. 5) is formed by a somewhat tubular protrusion 52 located on the rear walls 54,56 of the top and bottom of the box snap fitted between a pair of opposed spherical protrusions 58 located on the respective rear wall opposed to that on which the tubular protrusion is disposed. The ends of the plastic tubular protrusions are planar and are engaged by the plastic spherical protrusions to form the hinges.

Figure 2:
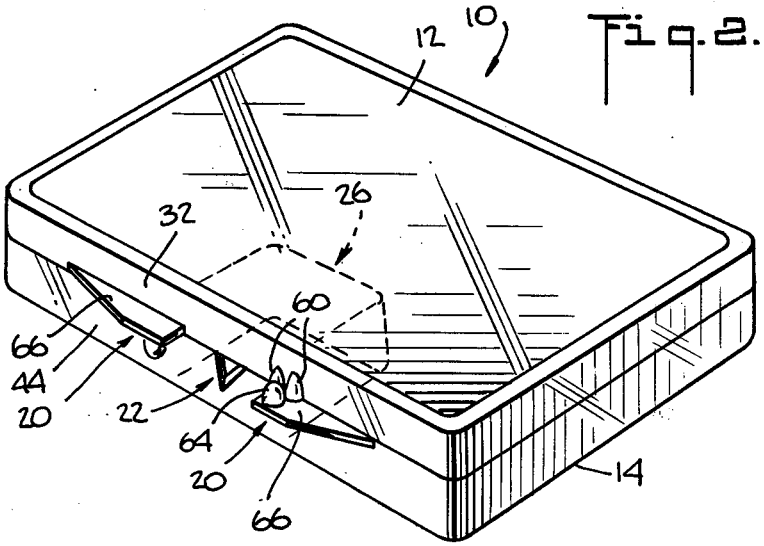
FIG. 2 is a front perspective view of the box shown in FIG. 1 with the box closed.

The snap latches 20 (FIGS. 1 and 2) are located on the front walls of the top and bottom of the box adjacent cutter 22. Each lock comprises a pair of spaced projections 60 which form an indentation 62 therebetween along the outside of the front walls and a protrusion 64 on a flange 66 extending outwardly from the front walls of the top and bottom of the box. Each protrusion 64 is located so that it will be intermediate the projections 60 when the box is closed, the protrusion 64 being snapped into the indentation 62 and engaged by the projections 60.

To stabilize the container during cutting, a support strip 68 is provided along the top rear wall 54 on the internal side thereof. The strip extends from the top end of the top portion of the container and projects downwardly beyond the top rear wall to extend along a portion of the lower rear wall 56. The width of the strip 68 and the distance it projects along the lower rear wall are sufficient to substantially reduce relative transverse movement between the upper and lower container portions during cutting.

Figure 6:
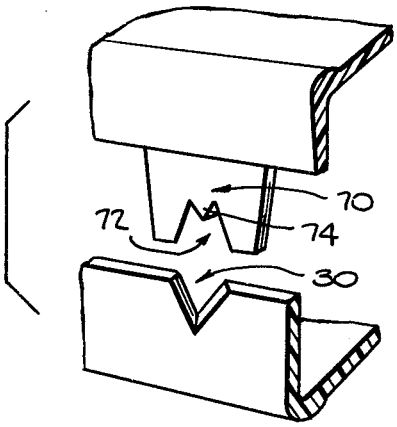
FIGS. 6 and 7 are enlarged front views of a portion of a capsule box each depicting a cutter according to another embodiment of the invention.
Figure 7:
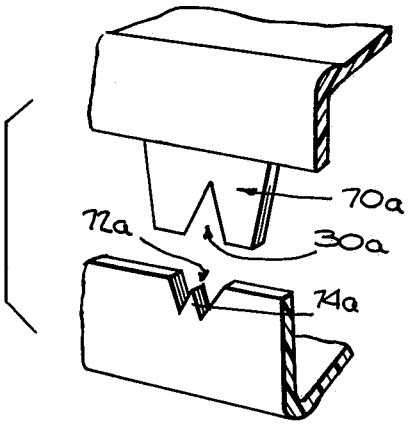
Figure 8:
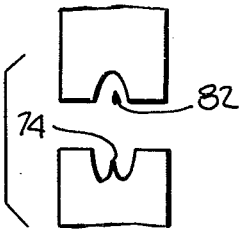
FIGS. 8–10 are schematic diagrams illustrating other embodiments of cutters according to the invention.
Figure 9:
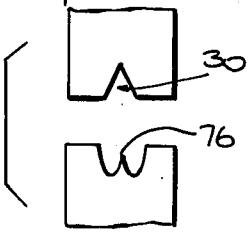
Figure 10:
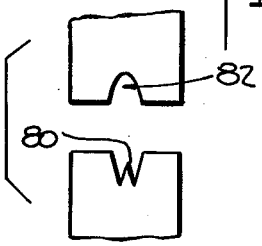

The upper and lower blades may have configurations other than the one shown in FIGS. 1–4. In FIG. 6, the upper blade 70 includes a cut-out 72 and a downwardly projecting V-shaped blade portion 74. The blade and cut-out are in the shape of an inverted W. As described for cutter 22, the V-shaped blade engages the capsule in the V-shaped notch 30 during cutting. The edges of upper blade 70 are tapered as described for the edges of blade 28. The upper and lower blades shown in FIG. 7 are reversed from the positions of FIG. 6, i.e., the W-shaped blade is disposed in the bottom of the box and the notch in the top of the box. Other blade configurations are shown in FIGS. 8–10. In each of those blade configurations a projecting blade portion (76, 78 and 80) is provided to engage the capsule during cutting. In FIGS. 8 and 10, the trough-shaped notch 82 is U-shaped. The blade edges in the embodiments of FIGS. 8–10 are tapered as described above for cutter 22.

As mentioned, the container top 12 and bottom 14 each are unitary pieces made of plastic material, i.e., in the container top and bottom, the upper blade, lower blade, hinges, snap locks, compartment halves, and the support strip form a unitary structure with the top or bottom. The top and bottom may be formed integrally with the blades, hinges, locks, compartment halves and support strip by, for example, a molding process.

The advantages of the present invention, as well as certain changes and modifications of the disclosed embodiments thereof, will be readily apparent to those skilled in the art. It is the applicants' intention to cover by his claims all those changes and modifications which could be made to the embodiments of the invention herein chosen for the purpose of the disclosure without departing from the spirit and scope of the invention. Protection by Letters Patent of this invention in all its aspects as the same are set forth in the appended claims is sought to the broadest extent that the prior art allows.

What is claimed is:

1. A container for holding elastic capsules and the like comprising a lower container portion and an upper container portion hingedly connected thereto, said container portions forming a first enclosure when hinged closed, a first cutting member secured to one of said upper and lower container portions and a second cutting member secured to the other of said upper and lower container portions, said cutting members having cooperating cutting surfaces which are adapted to cut an elastic capsule upon closure of said container portions and sever the elastic capsule into two parts, said cutting members including engaging means adapted to engage the elastic capsule during cutting to facilitate cutting and severing of the elastic capsule.

2. The container recited in claim 1, wherein said first cutting member comprises a trough-shaped notch in a wall of one of said container portions adapted to receive a portion of the elastic capsule therein and said second cutting member comprises a blade secured to an opposed wall of the other of said container portions which includes a cut-out therein with said blade projecting centrally within the cut-out, said blade being V-shaped and terminating in an apex at the projecting end thereof, said notch and said blade being superposed and cooperating to form a shear, said apex being adapted to pierce the elastic capsule placed in said notch upon closure of said container portions, and said apex of said V-shaped blade and said trough-shaped notch cooperating to engage the elastic capsule and comprising said engaging means.

3. The container recited in claim 2, wherein said container portions including said cutting members each are a unitary structure.

4. The container recited in claim 2, wherein said notch is disposed in the lower container portion and the blade is disposed in the upper container portion.

5. The container recited in claim 2, wherein said cut-out in said second cutting member is approximately co-extensive in width with the widest part of said notch, and said second cutting member includes edge portions extending adjacent each side of the centrally projecting blade.

6. The container recited in claim 5, wherein sides of said notch, sides of the projecting blade and said edge portions are tapered to form the shear.

7. The container recited in claim 1 and further comprising means adjacent the cutting means for receiving and retaining a portion of the elastic capsule cut upon closure of said container.

8. The container recited in claim 7, wherein said means comprises opposed compartment portions in the upper and lower container portions which form a second enclosure within the first enclosure when the container is closed.

9. The container recited in claim 8, wherein each compartment portion includes walls extending into said first enclosure from said lower and upper container portions to form said second enclosure, one of the walls of each compartment portion being formed by a wall of the respective container portion.

10. The container recited in claim 9, wherein said upper and lower container portions and respective compartment portions form unitary structures.

11. The container recited in claim 1, wherein said container portions and said cutting members are made of plastic, said cutting members being integrally formed in said container portions.

* * * * *